US010199185B2

(12) United States Patent
Carrea

(10) Patent No.: US 10,199,185 B2
(45) Date of Patent: Feb. 5, 2019

(54) ELECTRIC SWITCH

(71) Applicant: Microprecision Electronics Holding SA, Vouvry (CH)

(72) Inventor: Vito Carrea, Yverdon-les-Bains (CH)

(73) Assignee: Microprecision Electronics Holding SA, Vouvry (CH)

( * ) Notice: Subject to any disclaimer, the term of this patent is extended or adjusted under 35 U.S.C. 154(b) by 0 days.

(21) Appl. No.: 15/346,244

(22) Filed: Nov. 8, 2016

(65) Prior Publication Data

US 2017/0133176 A1 May 11, 2017

(30) Foreign Application Priority Data

Nov. 9, 2015 (EP) ..... 15193656

(51) Int. Cl.
*H01H 13/14* (2006.01)
*H01H 13/06* (2006.01)
(Continued)

(52) U.S. Cl.
CPC ..... *H01H 13/14* (2013.01); *H01H 3/12* (2013.01); *H01H 13/06* (2013.01); *H01H 13/18* (2013.01);
(Continued)

(58) Field of Classification Search
CPC ..... H01R 24/46; H01R 13/7033; H01R 13/65802; H01H 13/12; H01H 13/52;
(Continued)

(56) References Cited

U.S. PATENT DOCUMENTS 7,442,895 B2 * 10/2008 Bauer ..... H01H 1/42 200/531

FOREIGN PATENT DOCUMENTS

| | | | |
|---|---|---|---|
| DE | 2551858 | A1 | 6/1977 |
| EP | 1858043 | A1 | 11/2007 |
| WO | 2004068520 | A1 | 8/2004 |

OTHER PUBLICATIONS

European Search Report; European Patent Office; European Patent Application No. EP15193656; dated Jan. 27, 2016; 2 pages.

* cited by examiner

*Primary Examiner* — Ahmed Saeed
(74) *Attorney, Agent, or Firm* — Taft Stettinius & Hollister LLP

(57) ABSTRACT

The present invention relates to an electric switch including a hollow cylindrical casing delimiting a cavity, and an actuator that can slide inside the cavity along an axial direction defined by the casing, and including at least one upper part positioned at least partially outside the casing and at least one lower part positioned inside the cavity. The electric switch also includes a contact block movable under the action of the actuator along the axial direction between two specific positions, namely upstream and downstream contact positions, with the contact block having at least two conductive areas, namely upstream and downstream conductive areas respectively positioned at the two ends of an oblong opening formed inside the contact block, and with the ends positioned in an offset manner along the axial direction. The electric switch further includes a pair of electrical contacts, namely upstream and downstream electrical contacts respectively projecting into the oblong opening. The upstream or downstream conductive area, respectively, and the upstream or downstream electrical contact, respectively, are electrically connected in the upstream or downstream contact position, respectively, of the contact block, thus closing a first electrical circuit or a second electrical circuit, respectively.

16 Claims, 4 Drawing Sheets

(51) Int. Cl.

| | |
|---|---|
| ***H01H 3/12*** | (2006.01) |
| ***H01H 13/18*** | (2006.01) |
| ***H01H 13/50*** | (2006.01) |
| ***H01H 13/52*** | (2006.01) |

(52) U.S. Cl.
CPC ..... *H01H 13/50* (2013.01); *H01H 13/52* (2013.01); *H01H 2223/002* (2013.01)

(58) Field of Classification Search
CPC ..... H01H 1/242; H01H 71/08; H01H 1/42; H01H 2001/0005; H01H 23/12; H01H 11/0012; H01H 13/20; H01H 13/36; H01H 13/365; H01H 13/40; H01H 15/005; H01H 1/16; H01H 1/5866; H01H 13/14; H01H 13/50; H01H 13/18; H01H 13/06; H01H 3/12; H01H 2223/002; H01H 1/20; H01H 1/2025
USPC ..... 200/51.1, 51 R, 51.09, 270, 276.1, 275, 200/252, 284, 276, 61.53, 243, 571, 341, 200/50
See application file for complete search history.

ELECTRIC SWITCH

CROSS REFERENCE TO RELATED APPLICATIONS

This application claims priority to European Patent Application No. 15193656.4 filed Nov. 9, 2015, the contents of which are incorporated herein by reference in their entirety.

TECHNICAL FIELD

The present invention relates to an electric switch comprising an actuator that is axially movable inside the housing of the switch.

PRIOR ART

At present there is a relatively wide range of sensors that can be used in automated process control installations. One possible sensor is an electric switch operable by a push button and positioned so as to detect a limit state of a given device. One application that may be envisaged may, for example, be the detection of the opening and closing of an electromagnetic brake. This is provided by placing an electric switch in such a way that it is actuated in the middle of the air gap of the electromagnetic brake. When the brake is closed, the air gap is also closed, thus actuating the switch. When the brake is opened, the switch is actuated when the opening of the air gap is beyond the release point of the switch. The electric switches used in this type of application usually operate on the principle of snap-action closing, in which the push button, by pressing on a spring, changes the position of a moving electrical contact. However, these snap-action switches are characterized by a differential movement of the spring, creating a hysteresis phenomenon. This is because, when the device returns to its original state, the push button of the snap-action switch releases its pressure on the spring, thereby changing the position of the moving electrical contact. Owing to the differential movement of the spring in this release phase, however, the closing or opening of the first and second electrical circuits does not take place for the same limit states as it does in the compression phase of the spring. This results in a lack of reliability in this type of electric switch, which cannot provide precise detection of the variation of a small air gap.

Additionally, brake manufacturers find it useful to monitor the wear of the brake, which is manifested by an increase of the air gap. This monitoring requires the use of a second snap-action switch.

The object of the present invention is therefore to provide an electric switch that is free of the drawbacks of snap-action electric switches and enables both the air gap opening and the brake wear to be monitored simultaneously.

DISCLOSURE OF THE INVENTION

To this end, according to the invention, an electric switch is proposed, comprising:

- a hollow cylindrical casing delimiting a cavity,
- an actuator that can slide inside said cavity along an axial direction defined by the casing, said actuator comprising at least one upper part positioned at least partially outside the casing and at least one lower part positioned inside said cavity,
- a contact block which is movable under the action of said actuator along said axial direction between two specific positions, namely an upstream contact position and a downstream contact position, with an oblong opening formed inside said contact block, said contact block having at least two conductive areas, namely an upstream conductive area and a downstream conductive area, respectively positioned at the two ends of said oblong opening, said ends being positioned in an offset manner along said axial direction,
- a pair of electrical contacts, namely an upstream electrical contact and a downstream electrical contact respectively, projecting into said oblong opening, wherein said upstream or downstream conductive area, respectively, and said upstream or downstream electrical contact, respectively, are electrically connected in the upstream or downstream contact position, respectively, of said contact block, thus closing a first electrical circuit or a second electrical circuit, respectively.

Other advantageous configurations of the present invention are defined in the dependent claims 2 to 15.

In this configuration, the electric switch of the present invention has numerous advantages over snap-action electric switches. In the first place, it is easy to manufacture, owing to its lack of structural complexity. This results in a low production cost. Secondly, by contrast with snap-action switches, it does not give rise to the aforementioned hysteresis phenomenon. Precise detection is therefore possible, because of the absence of this phenomenon of hysteresis. Thirdly, the opening or closing of the electrical circuits always takes place for the same levels of external thrust exerted on the actuator. In the fourth place, it can easily be adapted to users' requirements because of the use of a single contact block linking the pair of moving electrical contacts. Thus, by modifying the spacing between these moving electrical contacts, that is to say the axial width of the oblong opening formed inside said contact block, it is possible to modify the travel for moving from the open position of the first electrical circuit to the closed position.

BRIEF DESCRIPTION OF THE DRAWINGS

Other characteristics and advantages of the present invention will be more clearly understood from a perusal of a particular embodiment of the invention, and by reference to the drawings, in which.

DETAILED DESCRIPTION OF AN EMBODIMENT OF THE INVENTION

With reference to FIGS. 1 to 4, an electric switch according to the invention is represented. This electric switch 10 is formed by a hollow cylindrical casing 11 open at its lower 11*i* and upper 11*j* ends, and delimiting an internal cavity 12 of circular section. According to other exemplary embodiments, the cavity 12 may, evidently, have a cross section which is rectangular or any other suitable shape.

In the present description, unless specified otherwise, an axial direction is a direction parallel to the main axis X of the cavity. Additionally, a radial direction is a direction perpendicular to the main axis X of the cavity and intersecting this axis. Unless specified otherwise, the adjectives and adverbs "axial", "radial", "axially" and "radially" are used with reference to the aforesaid axial and radial directions. Similarly, an axial plane is a plane containing the main axis X of the cavity, and a radial plane is a plane perpendicular to this axis. Additionally, an axial section is a section along an axial plane, and a radial section is a section along a radial plane.

Figure 1:
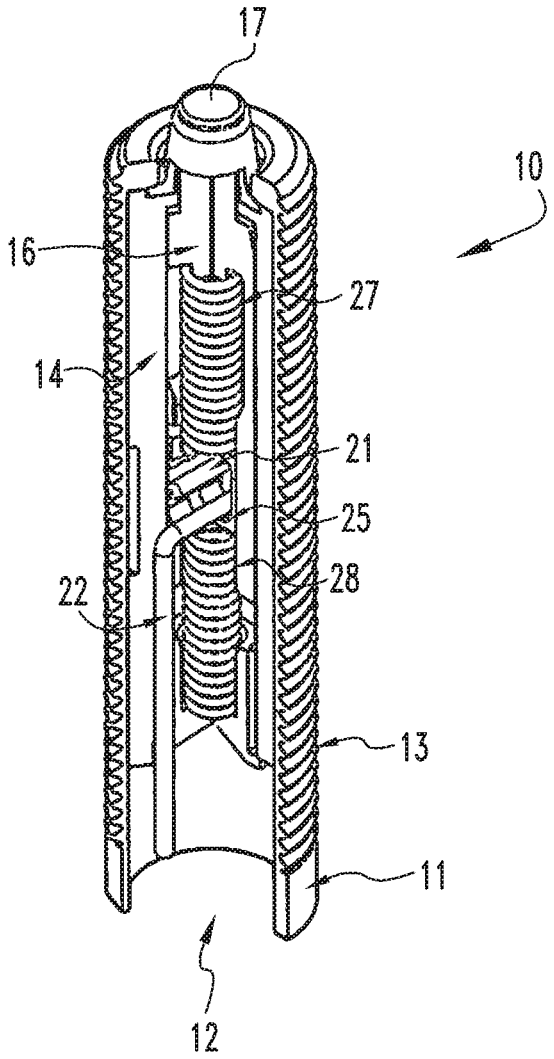
FIG. 1 is a partially cut-away perspective view of a switch according to the invention.
Figure 2:
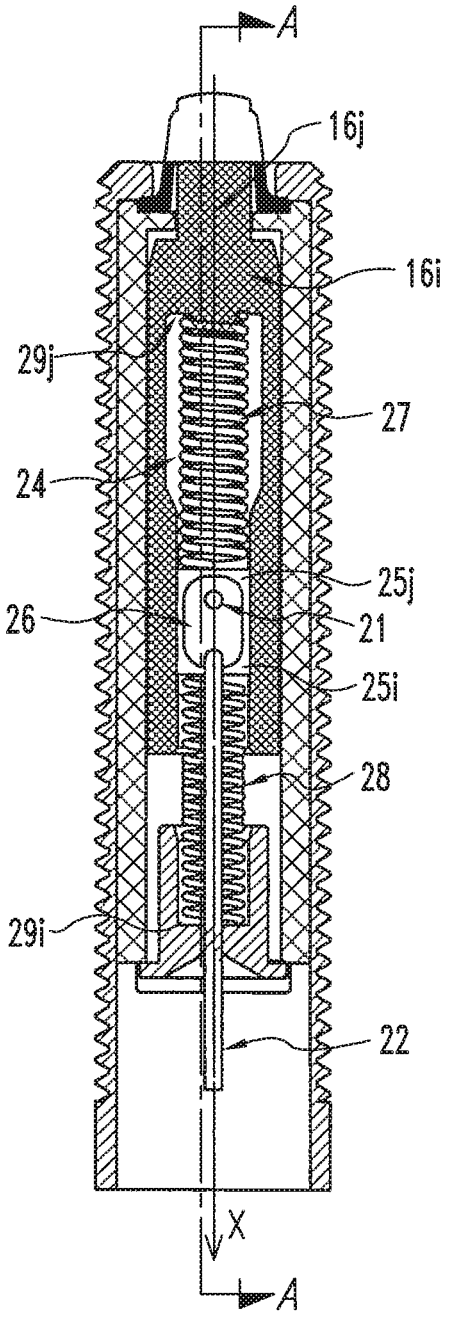
FIG. 2 is an axial sectional view of the switch shown in FIG. 1, in a first position of use of the switch, the first electrical circuit being open and the second electrical circuit being closed.
Figure 3:
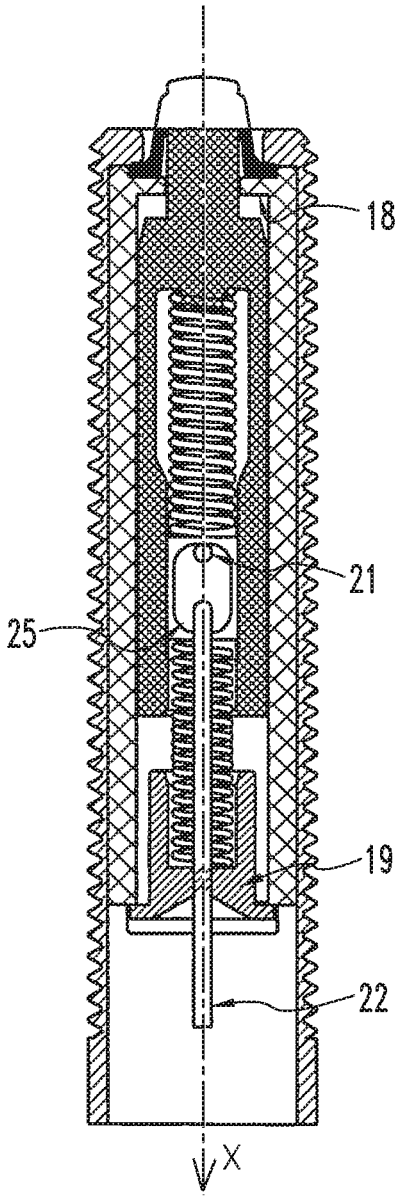
FIG. 3 is a view similar to FIG. 2, but in a second position of use of the switch, the first electrical circuit being closed and the second electrical circuit being open.
Figure 4:
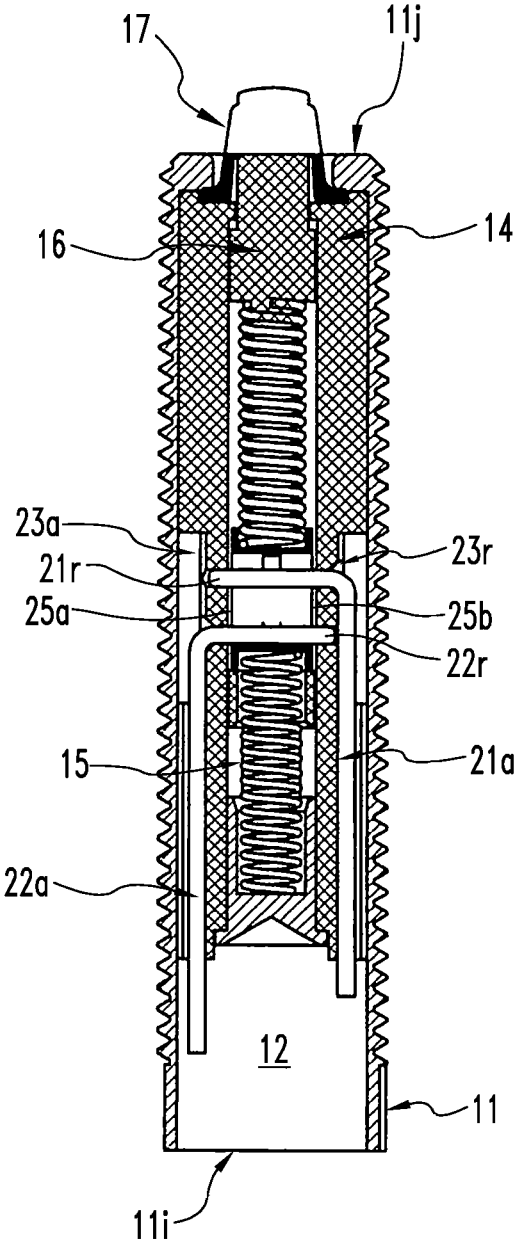
FIG. 4 is a sectional view taken along the line A-A of FIG. 2.

Furthermore, unless specified otherwise, the adjectives "upper" and "lower" are used with reference to the direction of the axis X as shown on FIGS. 2 and 3. Thus the axis X runs from the upper end of the casing towards its lower end.

Finally, the terms "upstream" and "downstream" are defined with respect to the direction of the axis X, which corresponds to the direction of movement, inside the cavity, of the actuator which is defined in the following text of this description.

The outer periphery of the casing 11 is advantageously provided with a thread 13 over almost the whole of its length, to facilitate its fastening to a support structure by screwing. A plastic bush 14 of substantially tubular shape is inserted into the cavity 12. The bush 14 defines an internal housing 15 in which an actuator 16 is slidably received. As shown in FIG. 3, this internal housing 15 is delimited, on the one hand, by an upper annular shoulder 18 which limits the movement of the actuator 16 in the upstream direction, and, on the other hand, by a cap 19 fastened at the lower end of the bush 14, said cap 19 limiting the movement of the actuator 16 in the downstream direction. As shown in FIG. 2, the actuator 16 takes the form of two parts, namely an upper part 16*j* which projects from the casing 11 at its upper end 11*j*, and a lower part 16*i*, which slides inside the internal housing 15 of the bush 14. The upper part 16*j* of the actuator 16 is completely covered by an elastic membrane 17 whose edges are clamped between the upper end 11*j* of the casing 11 and the upper annular shoulder 18 of the bush 14, said membrane 17 thus preventing any infiltration of dust or liquid into the casing 11.

The actuator 16 is configured to change the operating state of the switch 10 according to the axial thrust exerted on the upper part 16*j* of said actuator. In fact, depending on the intensity of this axial thrust, the actuator 16 may move in a downstream or upstream direction, thus causing the opening or closing of electrical circuits. These electrical circuits are, notably, formed by fixed electrical contacts and moving electrical contacts designed to come into contact with said fixed electrical contacts when the actuator 16 is in what is called the open position, and to cease being in contact with said fixed electrical contacts when the actuator is in what is called the closed position.

In the variant embodiment shown in FIGS. 1 to 4, the electric switch 10 comprises two fixed electrical contacts, namely an upstream fixed electrical contact 21 and a downstream fixed electrical contact 22, which are positioned in an offset manner along the axial direction inside the housing 11. Advantageously, these fixed electrical contacts 21, 22 are fitted in the thickness of the bush 14, each taking the form of an L-shaped metal rod, of which one segment 21*r* or 22*r* extends radially while the other segment 21*a* or 22*a* extends axially. For this purpose, the bush 14 comprises a plurality of radial channels 23*r* and axial channels 23*a*, formed in its thickness, said channels being designed to house at least partially said radial segments 21*r*, 22*r* and axial segments 21*a*, 22*a* of the electrical contacts 21, 22. The radial segments 21*r*, 22*r* of the electrical contacts 21, 22 project into a central void 24 of the actuator 16 in two axially offset positions, the radial segment 21*r* of the upstream fixed electrical contact 21 being positioned upstream from the radial segment 22*r* of the downstream fixed electrical contact 22.

The electric switch 10 also comprises two moving electrical contacts, namely an upstream moving electrical contact and a downstream moving electrical contact, which are positioned in an offset manner along the axial direction inside the housing 11. In the illustrated variant, the downstream and upstream moving electrical contacts are combined within a single contact block 25 housed slidably inside the central void 24 of the actuator 16, and take the form, respectively, of upstream 25*j* and downstream 25*i* conductive areas positioned at the axial ends of an oblong opening 26 formed inside said contact block 25. The contact block 25 is positioned in such a way that the radial segments 21*r*, 22*r* of the electrical contacts 21, 22 project into said oblong opening 26, the upstream conductive area 25*j* being positioned upstream of the radial segment 21*r* and the downstream conductive area 25*i* being positioned downstream of the radial segment 22*r*. Advantageously, the contact block 25 is entirely made of a conductive material. In the illustrated variant, the contact block 25 takes the form of a parallelepipedal block having two opposite lateral faces 25*a*, 25*b* which are perpendicular to the radial segments 21*r*, 22*r* of the fixed electrical contacts 21, 22. The oblong opening 26 passes through each of said lateral faces 25*a*, 25*b* so that each of the fixed electrical contacts 21, 22 can project into the oblong opening 26 from a different lateral face. The contact block 25 slides inside the central void 24 under the combined action of an upstream spring 27 and a downstream spring 28. The upstream spring 27 bears at its lower end on the upper face of the contact block 25 and at its upper end on an upper stop element 29*j* fixed to the actuator 16. In the illustrated variant, this upper stop element 29*j* is formed by the end of the central void 24. In this configuration, the external axial thrust exerted on the actuator 16 tends to move the contact block 25 via the upstream spring 27 towards an upstream contact position, in which the upstream conductive area 25*j* is in contact with the upstream fixed electrical contact 21. If the external axial thrust on the actuator 16 from this upstream contact position is increased, the contact block 25 will remain immobile on the fixed contact 21 under the action of the spring 27, while the actuator 16 will undergo an additional travel. The downstream spring 28 bears at its upper end on the lower face of the contact block 25 and at its lower end on a lower stop element 29*i* fixed to the bush 14, and therefore to the casing 11. In the illustrated variant, this lower stop element 29*i* is formed by an inner face of the cap 19, which is centrally recessed to receive said lower end. In this configuration, the downstream spring 28 exerts an axial thrust on the assembly formed by the actuator 16 and the contact block 25, in such a way that it tends to move this assembly towards a downstream contact position, in which the downstream conductive area 25*i* is in contact with the downstream fixed electrical contact 22. Advantageously, this assembly is entirely made of conductive metal. In the illustrated variant, the stiffnesses of the upstream and downstream springs 27, 28 are selected so that the contact block 25 is in its downstream contact position when the actuator 16 is not subjected to any external axial thrust, as shown in FIG. 2. On the other hand, the stiffness of the upstream spring 27 is advantageously greater than the stiffness of the downstream spring 28, in such a way that, during the movement from the downstream contact position to the upstream contact position, the upstream spring 27 does not undergo previous compression before the contact block 25 starts to move. This is because such previous compression could retard the opening of the electrical circuit of which the downstream electrical contact 22 forms part, thereby preventing the immediate detection of an external axial thrust exerted on the actuator. The stiffnesses of the upstream and downstream springs 27, 28 are also advantageously selected so that the compression of the upstream spring 27 begins when the contact block 25 is in its upstream contact position, as shown in FIG. 3, and when the actuator 16 is subjected to an additional external axial thrust. Thus an additional movement of the actuator 16 in the downstream direction from the position shown in FIG. 3 will not cause an additional movement of the contact block 25 in the downstream direction, but simply a compression of the upstream spring 27, thus preventing any damage to the upstream fixed electrical contact 21.

The variant embodiment shown in FIGS. 1 to 4 is evidently not limiting on the invention. It is only one of the possible embodiments of the invention. However, it differs from the other possible embodiments in the choice of using two completely distinct sub-assemblies, namely a first sub-assembly formed by the casing alone and a second sub-assembly formed by the plastic bush in which the actuator, the moving contact block, the pair of fixed electrical contacts and the upstream and downstream spring are positioned. In this configuration, the assembly and disassembly of the electric switch are easily carried out simply by inserting the second sub-assembly into the first sub-assembly. The user can therefore easily modify the electric switch by changing only the second sub-assembly, without changing the first sub-assembly.

The invention claimed is:

1. Electric switch comprising:

a hollow cylindrical casing delimiting a longitudinal cavity extending along an axial direction defined by the casing, an actuator that can slide inside said longitudinal cavity along said axial direction, said actuator comprising at least one upper part positioned at least partially outside the casing and at least one lower part positioned inside said longitudinal cavity, a contact block which is located inside said longitudinal cavity and which is movable under the action of said actuator so as to slide inside said longitudinal cavity along said axial direction between two axial positions inside said longitudinal cavity, said two axial positions including an upstream contact position and a downstream contact position, with an oblong opening formed inside said contact block, said contact block having at least two conductive areas, including an upstream conductive area and a downstream conductive area, respectively positioned at ends of said oblong opening, said ends being positioned in an offset manner along said axial direction, a pair of electrical contacts, including an upstream electrical contact and a downstream electrical contact respectively, projecting into said oblong opening, wherein said upstream or downstream conductive area, respectively, and said upstream or downstream electrical contact, respectively, are electrically connected in the upstream or downstream contact position, respectively, of said contact block, thus closing a first electrical circuit or a second electrical circuit respectively.

2. Electric switch according to claim 1, wherein said actuator has a central void inside which the contact block is slidably housed.

3. Electric switch according to claim 1, wherein the contact block is formed entirely of metal.

4. Electric switch according to claim 3, wherein the downstream spring has a lower end that bears on a lower stop element fixed to the casing and has an upper end that bears on a lower face of the contact block, and wherein the downstream spring and the lower stop element are formed entirely of metal.

5. Electric switch according to claim 1, wherein the contact block is in said downstream contact position when the actuator is not subjected to any external axial force.

6. Electric switch according to claim 1, wherein each of the electrical contacts comprises an L-shaped metal rod having at least a first segment extending perpendicularly to an axial direction defined by the casing and at least a second segment extending parallel to said axial direction.

7. Electric switch according to claim 1, wherein an elastic membrane completely covers the upper part of the actuator, thus preventing the infiltration of dust or liquid into the casing.

8. Electric switch according to claim 1, wherein the casing has at least one threaded area on a periphery of the casing.

9. Electric switch comprising:

a hollow cylindrical casing delimiting a cavity, an actuator that can slide inside said cavity along an axial direction defined by the casing, said actuator comprising at least one upper part positioned at least partially outside the casing and at least one lower part positioned inside said cavity, a contact block which is movable under the action of said actuator along said axial direction between two specific positions, said two specific positions including an upstream contact position and a downstream contact position, with an oblong opening formed inside said contact block, said contact block having at least two conductive areas, including an upstream conductive area and a downstream conductive area, respectively positioned at ends of said oblong opening, said ends being positioned in an offset manner along said axial direction, a pair of electrical contacts, including an upstream electrical contact and a downstream electrical contact respectively, projecting into said oblong opening, wherein said upstream or downstream conductive area, respectively, and said upstream or downstream electrical contact, respectively, are electrically connected in the upstream or downstream contact position, respectively, of said contact block, thus closing a first electrical circuit or a second electrical circuit respectively;

wherein said actuator has a central void inside which the contact block is slidably housed; and wherein the contact block slides inside said central void under a combined action of an upstream spring and a downstream spring with a lower end and an upper end, said upstream spring being configured to move the contact block towards said upstream contact position and said downstream spring being configured to move the contact block towards said downstream contact position.

10. Electric switch according to claim 9, wherein a stiffness of the upstream spring is greater than a stiffness of the downstream spring.

11. Electric switch according to claim 9, wherein the upstream spring has an upper end that bears on an upper stop element fixed to the actuator and has a lower end that bears on an upper face of the contact block.

12. Electric switch according to claim 11, wherein the upper stop element is formed by an inner face of the actuator, which defines an end of the central void.

13. Electric switch according to claim 9, wherein the downstream spring has a lower end that bears on a lower stop element fixed to the casing and has an upper end that bears on a lower face of the contact block.

14. Electric switch according to claim 13, wherein the lower stop element is formed by an inner face of a cap fastened to a lower end of a plastic bush of substantially tubular shape, inserted into the casing, said cap being centrally recessed so as to receive the lower end of the downstream spring.

15. Electric switch comprising:

a hollow cylindrical casing delimiting a cavity, an actuator that can slide inside said cavity along an axial direction defined by the casing, said actuator comprising at least one upper part positioned at least partially outside the casing and at least one lower part positioned inside said cavity, a contact block which is movable under the action of said actuator along said axial direction between two specific positions, said two specific positions including an upstream contact position and a downstream contact position, with an oblong opening formed inside said contact block, said contact block having at least two conductive areas, including an upstream conductive area and a downstream conductive area, respectively positioned at ends of said oblong opening, said ends being positioned in an offset manner along said axial direction, a pair of electrical contacts, including an upstream electrical contact and a downstream electrical contact respectively, projecting into said oblong opening, wherein said upstream or downstream conductive area, respectively, and said upstream or downstream electrical contact, respectively, are electrically connected in the upstream or downstream contact position, respectively, of said contact block, thus closing a first electrical circuit or a second electrical circuit respectively;

wherein the contact block is formed entirely of metal; and wherein a lower stop element is formed by an inner face of a cap fastened to a lower end of a plastic bush of substantially tubular shape, inserted into the casing, said cap being centrally recessed so as to receive a lower end of a downstream spring, and wherein the downstream spring and the lower stop element are formed entirely of metal.

16. Electric switch comprising:

a hollow cylindrical casing delimiting a cavity, an actuator that can slide inside said cavity along an axial direction defined by the casing, said actuator comprising at least one upper part positioned at least partially outside the casing and at least one lower part positioned inside said cavity, a contact block which is movable under the action of said actuator along said axial direction between two specific positions, said two specific positions including an upstream contact position and a downstream contact position, with an oblong opening formed inside said contact block, said contact block having at least two conductive areas, including an upstream conductive area and a downstream conductive area, respectively positioned at ends of said oblong opening, said ends being positioned in an offset manner along said axial direction, a pair of electrical contacts, including an upstream electrical contact and a downstream electrical contact respectively, projecting into said oblong opening, wherein said upstream or downstream conductive area, respectively, and said upstream or downstream electrical contact, respectively, are electrically connected in the upstream or downstream contact position, respectively, of said contact block, thus closing a first electrical circuit or a second electrical circuit respectively;

wherein each of the electrical contacts comprises an L-shaped metal rod having at least a first segment extending perpendicularly to an axial direction defined by the casing and at least a second segment extending parallel to said axial direction; and wherein a lower stop element is formed by an inner face of a cap fastened to a lower end of a plastic bush of substantially tubular shape, inserted into the casing, said cap being centrally recessed so as to receive a lower end of a downstream spring, and wherein the plastic bush has one or more channels formed in a thickness of the plastic bush, said channels being designed to house at least partially said first and/or second segments of said metal rods.

* * * * *